United States Patent [19]

Tsukasaki

[11] Patent Number: 4,476,783

[45] Date of Patent: Oct. 16, 1984

[54] DEVICE OF SECURING A FILM BEARING INDICIA ON THE PRINTING ROLL UNDER TENSION

[75] Inventor: Yasuhiro Tsukasaki, Osakashi, Japan

[73] Assignee: Kabushiki Kaisha Shinko Kikai Seisakusho, Osaka, Japan

[21] Appl. No.: 527,901

[22] Filed: Aug. 30, 1983

[30] Foreign Application Priority Data

Sep. 1, 1982 [JP] Japan ..... 57-132720[U]

[51] Int. Cl.[3] ..... B41F 27/06; B41F 27/12

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 350,916 | 10/1886 | Crowell | 101/378 |
| 572,695 | 12/1896 | Cottrell | 101/378 |
| 629,930 | 8/1899 | Spalckharer | 101/415.1 |
| 3,757,690 | 9/1973 | Skiera et al. | 101/415.1 |
| 4,068,586 | 1/1978 | Frey et al. | 101/415.1 |

*Primary Examiner*—Clyde I. Coughenour
*Assistant Examiner*—William L. Klima
*Attorney, Agent, or Firm*—Jordan and Hamburg

[57] ABSTRACT

A device of securing a film bearing indicia on the surface of the printing roll under tension in an efficient and automatic way, the device comprising: a first engager and a second engager provided at each end of the film, a first receiving means and a second receiving means provided adjacent to each other on the peripheral surface of the printing roller, wherein the first receiving means is adapted to receive the first engager of the film and wherein the second receiving means is adapted to receive the second engager of the film, the second receiving means comprising a slotted rod rotatively placed in an accommodation groove produced in the printing roll, and a pinion secured to the terminating end of the rod, a rotor rotatively provided at one end face of the printing roll, the rotor having a first tooth zone and a second tooth zone in its periphery, wherein the first tooth zone is adapted to engage with the pinion and wherein the second tooth zone is adapted to engage with a ratchet mechanism provided in place alongside the periphery of the rotor, and a brake means for stopping the rotor from rotating in association with the rotation of the printing roll.

1 Claim, 4 Drawing Figures

DEVICE OF SECURING A FILM BEARING INDICIA ON THE PRINTING ROLL UNDER TENSION

BACKGROUND OF THE INVENTION

The present invention relates to a device of securing a film bearing indicia on the printing roll, and more particularly, to a device of securing a film bearing indicia on the printing roll in an automatic manner.

To explain the background of the present invention, reference will be made to FIGS. 1 and 2. The reference numeral 1 designates a printing roll, on which a film 2 bearing indicia 3 is placed. The film 2 has a first engager 4*a* at one end, and a second engager 4*b* at the other end, wherein the first engager 4*a* is engaged in a first recess 5 produced in the printing roll 1. The printing roller 1 has a catching means whereby the second engager 4*b* is caught so as to allow the film 2 to cover the printing roll 1. The catching means includes a groove 8, a rod 6 and a lengthwise recess 7 produced on the surface of the rod 6, as illustrated in FIG. 2. The rod 6 is rotable in the groove 8, thereby controlling the tension of the film 2 placed on the surface of the printing roll 1. The rod 6 has a extended boss at each end whereby the rod is rotated by means of a spanner 9. Although the detailed structure is not shown, it is arranged such that the rod 6 cannot rotate in the direction in which the film 2 becomes loose during the printing operation. When the film 2 is to be removed from the printing roll 1, the second engager 4*b* is disengaged from the recess 7.

This known device is disadvantageous in that at least two operators must attend to the placement of a film on the printing roll. One operator holds the film, and the other engages the film in the recess 7 while trying to stretch the film. In addition, a tool, such as a spanner or a driver, is required.

OBJECTS AND SUMMARY OF THE INVENTION

The present invention is directed to solve the problems involved in the prior art device, and has for its object to provide an improved device capable of placing a film bearing indicia on the printing roll under tension with the minimum of labor.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided a device of securing a film bearing indicia on the printing roll, which device comprises a first engager and a second engager provided at each end of the film, a first receiving means and a second receiving means provided adjacent to each other on the peripheral surface of the printing roller, wherein the first receiving means is adapted to receive the first engager of the film and wherein the second receiving means is adapted to receive the second engager of the film, the second receiving means comprising a slotted rod rotatively placed in an accommodation groove produced in the printing roll, and a pinion secured to the terminating end of the rod, a rotor rotatively provided in one end face of the printing roll, the rotor having a first tooth zone and a second tooth zone in its periphery, wherein the first tooth zone is adapted to engage with the pinion and wherein the second tooth zone is adapted to engage with a ratchet mechanism provided in place alongside the periphery of the rotor, and a brake means for stopping the rotor from rotating in association with the rotation of the printing roll.

BRIEF DESCRIPTION OF THE INVENTION

DETAILED DESCRIPTION OF THE INVENTION

Figure 1:
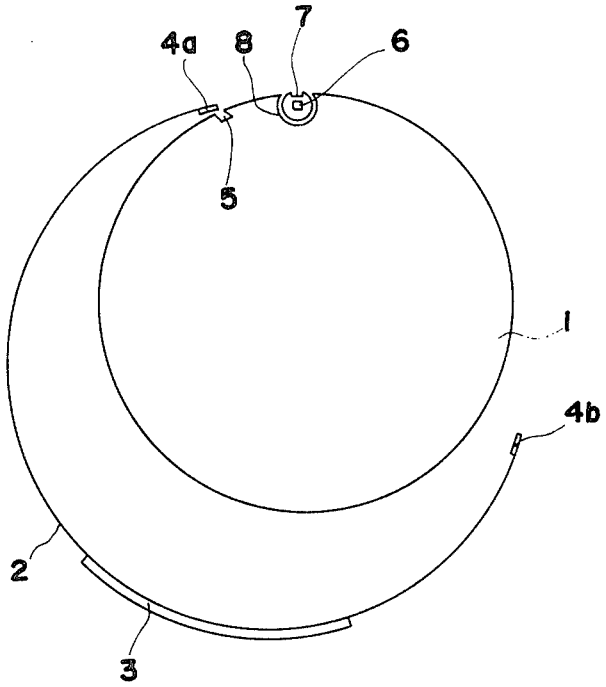
FIG. 1 (PRIOR ART)
FIG. 1 is a diagrammatic view exemplifying the principle of a prior art device.
Figure 2:
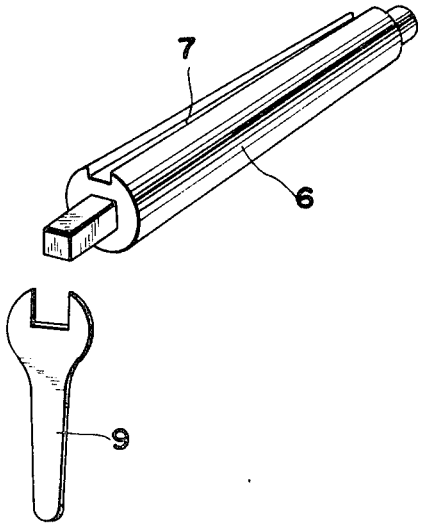
FIG. 2 (PRIOR ART)
FIG. 2 is a perspective view of a rod employed in the device of FIG. 1.
Figure 3:
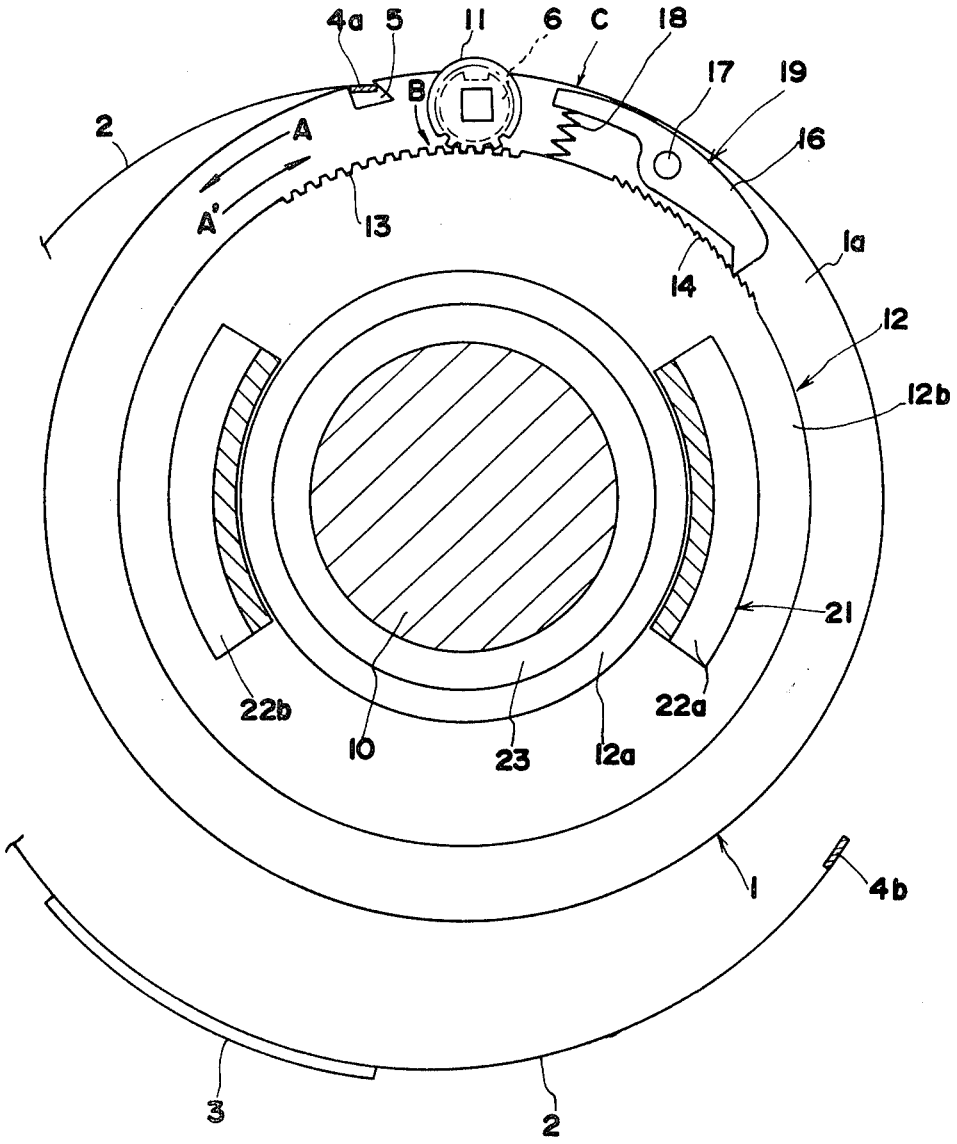
FIG. 3 is a diagrammatic view of a device embodying the present invention.
Figure 4:
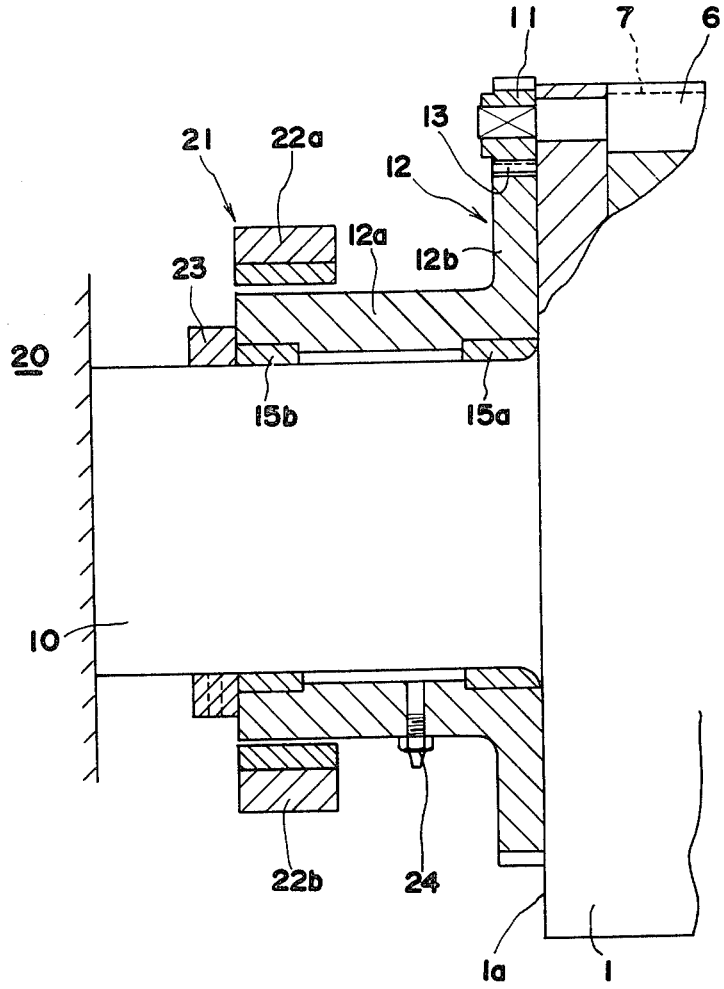
FIG. 4 is a diagrammatic side view of the device of FIG. 3.

In the drawings like reference numerals are used throughout FIGS. 1 to 4 to designate like parts and elements. Referring now to FIGS. 3 and 4, a rod 6 is provided with a pinion 11 at its terminating end. A shaft 10 of a printing roll 1 is rotatively carried by a rotor 12 through bearings 15*a*, 15*b*. The reference numeral 21 designates a brake unit, which includes brake shoes 22*a*, 22*b* applied to the rotor 12. The rotor 12 and the printing roll 1 are independently rotable about the same axis, that is, the axis of the printing roll 1. The reference numeral 24 designates a grease nipple whereby the bearings 15*a*, 15*b* are lubricated. The rotor 12 includes a base portion 12*b* and a cylindrical portion 12*a*. The base portion 12*b* is provided with two kinds of tooth zones 13 and 14, wherein the tooth zone 13 includes teeth of rectangular section whereas the tooth zone includes sharp saw-like teeth. The tooth zone 13 is intended to engage with the pinion 11. The diameter of the base portion 12*a* of the rotor 12 is smaller than the outside diameter of the printing roll 1 as clearly shown in FIG. 4, thereby forming a space 1*a* between the end face of the printing roll 1 and the peripheral edge of the base portion 12*b*. This space 1*a* provides a support for a ratchet mechanism 19, which includes a ratchet pawl 16, a pivot 17 and a spring 18, wherein the ratchet pawl 16 is engaged with the tooth zone 14. The ratchet pawl 16 is swingable about the pivot 17 under the restraint provided by the spring 18. The ratchet mechanism 19 is operated by an operator's finger, which is applied to a point indicated by the letter C, so as to release the ratchet pawl 16 from the tooth zone 14. The ratchet mechanism 19 is intended to allow the rotor 12 to rotate in one direction only; that is, in the direction indicated by the arrow A'.

The reference numeral 20 designates a fixed structure for carrying the printing roll 1, and the brake unit 21 is mounted thereon. As referred to above, the brake shoes 22*a*, 22*b* are applied to the rotor 12 under pneumatic pressure provided by a pneumatic cylinder (not shown). The reference numeral 23 designates a collar whereby the rotor 12 takes an appropriate axial position.

In operation, when the film 2 bearing indicia 3 is to be placed on printing roll 1, the engager 4*a* is engaged in the recess 5 in the aforementioned manner, from which the film 2 is stretched out, and covers the whole surface of the printing roll 1. Finally the engager 4*b* is engaged in the recess 7 of the rod 6. The brake unit 21 is operated to stop the rotor 12 from rotating in association with the printing roller 1. Then the printing roller 1 is slightly rotated in the direction indicated by the arrow A, thereby causing the pinion 11 to revolve along the tooth zone 13 while rotating abouts its own axis, that is, in the direction indicated by the arrow B. The angular displacement of the pinion 11 stretches the film 2. This stage is ensured by the ratchet mechanism 19, which prevents the rotor 12 from rotating in the direction indicated by the arrow A.

When the film 2 is secured on the printing roll 1, the brake unit 21 is switched off thereby to release the rotor 12 from the brake shoes *22a, 22b*. The printing roll 1 is put into regular operation. When the printing is finished, and the film 2 is to be removed from the printing roll 1, the ratchet mechanism 19 is pushed at the point C to release its pawl 16 from the tooth zone 14. Then the printing roll 1 is slightly rotated in the opposite direction, that is, in the direction indicated by the arrow A', thereby enabling the film 2 to become loose on the surface of the printing roll 1. The film 1 is now ready to be removed from the printing roll 1.

What is claimed is:

1. A device of securing a film bearing indicia on the printing roll under tension, the device comprising:

a first engager and a second engager provided at each end of the film, a first receiving means and a second receiving means provided adjacent to each other on the peripheral surface of the printing roller, wherein the first receiving means is adapted to receive the first engager of the film and wherein the second receiving means is adapted to receive the second engager of the film, the second receiving means comprising a slotted rod rotatively placed in an accommodation groove produced in the printing roll, and a pinion secured to the terminating end of the rod, a rotor rotatively provided at one end face of the printing roll, the rotor having a first tooth zone and a second tooth zone in its periphery, wherein the first tooth zone is adapted to engage with the pinion and wherein the second tooth zone is adapted to engage with a ratchet mechanism provided in place alongside the periphery of the rotor, and a brake means for stopping the rotor from rotating in association with the rotation of the printing roll.

* * * * *